US006326552B1

(12) United States Patent
Krause et al.

(10) Patent No.: US 6,326,552 B1
(45) Date of Patent: Dec. 4, 2001

(54) INSULATOR END FITTING WITH NON-MACHINED ANNULAR ATTACHMENT FLANGE

(75) Inventors: John A. Krause, Medina, OH (US); Jeffrey J. Kester, Bemus Point, NY (US)

(73) Assignee: Hubbel Incorporated, Orange, CT (US)

( * ) Notice: Subject to any disclaimer, the term of this patent is extended or adjusted under 35 U.S.C. 154(b) by 0 days.

(21) Appl. No.: 09/452,490

(22) Filed: Dec. 1, 1999

(51) Int. Cl.[7] ..... H01B 17/14

(52) U.S. Cl. ..... 174/158 R; 174/163 R; 174/154; 174/188

(58) Field of Search ..... 174/158 R, 154, 174/163 R, 165, 188, 189, 191, 209, 210, 211

(56) References Cited

U.S. PATENT DOCUMENTS

| | | | | |
|---|---|---|---|---|
| 3,672,712 | | 6/1972 | Davis | 287/20.2 R |
| 3,739,457 | | 6/1973 | Davis | 29/460 |
| 3,813,643 | | 5/1974 | Hartz | 339/223 S |
| 3,818,165 | | 6/1974 | Zavitsanos | 200/144 C |
| 3,898,372 | * | 8/1975 | Kalb | 174/179 |
| 4,027,124 | | 5/1977 | Marin et al. | 200/146 R |
| 4,066,322 | | 1/1978 | Brown et al. | 339/111 |
| 4,259,555 | | 3/1981 | Kii | 200/148 R |
| 4,355,200 | | 10/1982 | Wheeler et al. | 174/140 S |
| 4,414,429 | | 11/1983 | Kaczerginski et al. | 174/179 |
| 4,421,948 | * | 12/1983 | Willem | 174/158 R |
| 5,336,852 | * | 8/1994 | Goch et al. | 174/176 |
| 5,389,742 | * | 2/1995 | Clabburn et al. | 174/209 |
| 5,762,438 | | 6/1998 | Reed, II | 403/269 |
| 5,766,527 | | 6/1998 | Schildgen et al. | 264/104 |
| 5,885,427 | | 3/1999 | Pickering et al. | 204/293 |
| 6,064,010 | * | 5/2000 | Bessede | 174/176 |
| 6,105,248 | * | 8/2000 | Tani | 29/887 |

* cited by examiner

*Primary Examiner*—Dean A. Reichard
*Assistant Examiner*—W. David Walkenhorst
(74) *Attorney, Agent, or Firm*—Michael R. Swartz

(57) ABSTRACT

An end fitting for an insulator includes a main cast body for securement to an external structure and a non-machined annular flange rigidly attached at an end of the main cast body and defining a hole for receiving an end of a fiberglass rod to secure the annular flange to the fiberglass rod in assembling the insulator. At least a portion of the annular flange is formed of a preformed annular member defining at least an interior diameter of the annular flange. The use of the preformed annular member eliminates the need for two costly secondary machining operations to prepare the annular flange for receiving and crimping on the fiberglass rod of the insulator.

20 Claims, 2 Drawing Sheets

INSULATOR END FITTING WITH NON-MACHINED ANNULAR ATTACHMENT FLANGE

BACKGROUND OF THE INVENTION

1. Field of the Invention

The present invention generally relates to insulators and, more particularly, is concerned with an insulator end fitting with a non-machined annular attachment flange.

2. Description of the Prior Art

Insulators are widely used by the electric utility industry for a variety of applications. Heretofore, Ohio Brass, a subsidiary of Hubbell Incorporated, has manufactured and marketed a number of different types of insulators, sometimes referred to as polymer insulators, for different applications, such as deadend, suspension, transmission, line post and the like.

Referring to FIGS. 1 to 12, there is illustrated a typical prior art insulator 10. The insulator 10 basically includes an elongated fiberglass rod 12, a plurality of weathersheds 14 disposed end-to-end along the rod 12 and an end fitting 16 attached on each of a pair of opposite ends 12A of the fiberglass rod 12. The weathersheds 14 are typically made of rubber and are either molded directly around the rod 12 or slipped thereover with the use of a dielectric grease as a rubber-rod interface. The end fittings 16 are typically of various shapes, as seen in FIGS. 2 to 6, to serve a variety of utility applications and are normally made of ductile iron and fabricated by casting and either potted (glued) or crimped onto the ends of the fiberglass rod. Whether potted or crimped to the fiberglass rod, a hole 18 is first bored in one end 16A of a solid cast body of the end fitting 16 to receive one of the ends 12A of the rod 12.

Where a crimp attachment is to be used the end fitting fabrication steps typically employed are as follows. First, a cast of the solid body of the end fitting is made, such as in a sand cast mold. Next, a first machining operation is performed on the end fitting to provide a precise known outside diameter on the one end of the end fitting to use later in boring the hole. Following next, the whole end fitting is hot dip galvanized. Then, a second machining operation is performed on the end fitting by boring the hole in the end thereof to accept the end of the fiberglass rod. By employment of the two machining operations, the flange portion left on the end fitting about the hole has the desired thickness appropriate for the crimping operation. Ductile iron is usually used for the cast portion of the end fittings and, if ductile iron is used, then low carbon steel is used for the annular attachment flange. However, cast aluminum could be used for an end fitting and then the annular attachment flange would also be aluminum.

The above-described fabrication steps, though effective in producing an end fitting having a suitable end flange portion adapted to receive an end of the fiberglass rod, are nonetheless costly and time-consuming to carry out Consequently, there is a need for innovation in the method of fabricating the end fitting that will overcome these problems without introducing new problems in place thereof.

SUMMARY OF THE INVENTION

The present invention provides an insulator end fitting designed to satisfy the aforementioned need. The end fitting of the present invention involves casting the body of the end fitting with a non-machined annular attachment flange that utilizes a preformed annular member. This provides a more cost-effective and less complicated way of fabricating the end fitting by eliminating the need for the two secondary machining operations and their associated high costs of the prior art method of fabricating the attachment flange portion of the end fitting to prepare the end fitting for receiving and crimping on a fiberglass rod of the insulator.

Accordingly, the present invention is directed to an end fitting for an insulator which comprises: (a) a main cast body for securement to an external structure; and (b) a non-machined annular flange rigidly attached at an end of the main cast body and defining a hole for receiving an end of a fiberglass rod to secure the annular flange to the fiberglass rod in assembling the insulator. At least a portion of the annular flange is comprised of a preformed annular member defining at least an interior diameter of the annular flange.

More particularly, the preformed annular member can take any one of three different embodiments. In a first embodiment, the preformed annular member is a section of pipe. The end of the main cast body has an annular recess receiving an end of the section of pipe such that the main cast body is rigidly attached to the end of the section of pipe. In a second embodiment, the preformed annular member is a precut metal tube disposed at interior diameter of the annular flange. The annular flange includes an annular cast body surrounding the precut metal tube and integrally attached to the main cast body at the end thereof and made of the same material as the main cast body. In a third embodiment, the preformed annular member is a prestamped metal tubular member having interior and exterior annular walls disposed at the interior and exterior diameters of the annular flange. The annular flange includes an annular cast body disposed between the interior and exterior annular walls of the prestamped metal tubular member and integrally attached to the main cast body at the end thereof and made of the same material as the main cast body.

The present invention is also directed to an insulator which comprises: (a) an elongated fiberglass rod having a pair of opposite ends; (b) a plurality of weathersheds disposed along the fiberglass rod between the opposite ends thereof; and (c) a pair of end fittings each crimped to one of the opposite ends of the fiberglass rod, each of the end fittings having the construction as described above.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
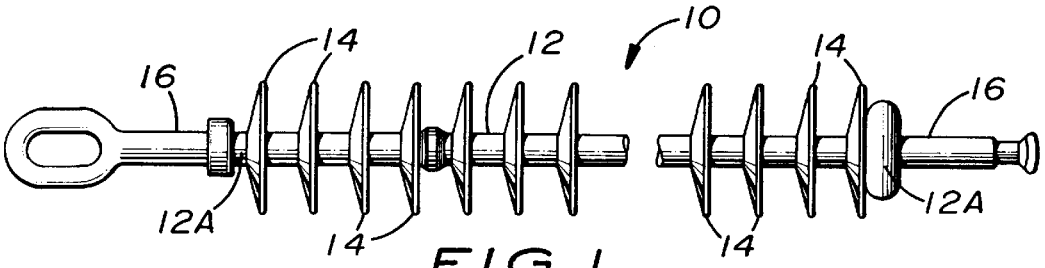
FIG. 1 (PRIOR ART)
FIG. 1 is a foreshortened longitudinal view of a prior art insulator.
Figure 2:
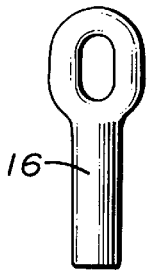
FIG. 2 (PRIOR ART)
FIG. 2 is a side elevational view of one type of end fitting shown disposed at one end of the prior art insulator of FIG. 1.
Figure 3:
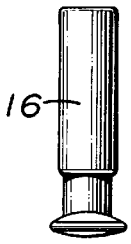
FIG. 3 (PRIOR ART)
FIG. 3 is a side elevational view of another type of end fitting shown disposed at the other end of the prior art insulator of FIG. 1.
Figure 4:
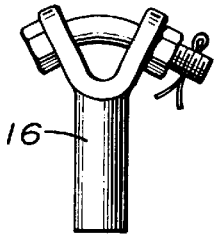
FIG. 4 (PRIOR ART)
FIG. 4 is a side elevational view of still another type of prior art end fitting.
Figure 5:
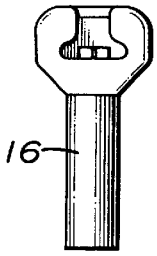
FIG. 5 (PRIOR ART)
FIG. 5 is a side elevational view of yet another type of prior art end fitting.
Figure 6:
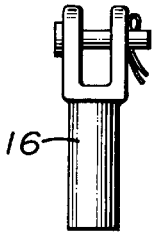
FIG. 6 (PRIOR ART)
FIG. 6 is a side elevational view of another type of prior art end fitting.
Figure 7:
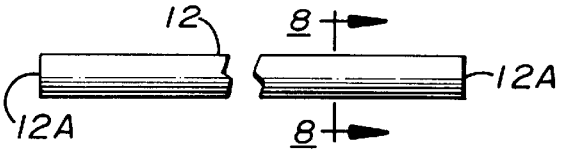
FIG. 7 (PRIOR ART)
FIG. 7 is a foreshortened longitudinal view of a fiberglass rod employed in the prior art insulator of FIG. 1.
Figure 8:
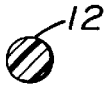
FIG. 8 (PRIOR ART)
FIG. 8 is a cross-sectional view of the rod taken along line 8—8 of FIG. 7.
Figure 10:
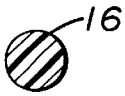
FIG. 10 (PRIOR ART)
FIG. 10 is a cross-sectional view of the end fitting taken along line 10—10 of FIG. 9.
Figure 9:
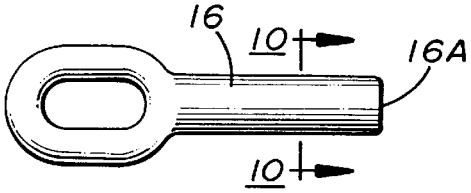
FIG. 9 (PRIOR ART)
FIG. 9 is a longitudinal view of a prior art chain eye end fitting employed at the left end of the insulator of FIG. 1.
Figure 11:
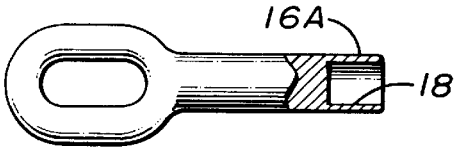
FIG. 11 (PRIOR ART)
FIG. 11 is a longitudinal view of the prior art chain eye end fitting similar to FIG. 9 with the end fitting being partially sectioned to show a hole bored in an end of the end fitting.
Figure 12:
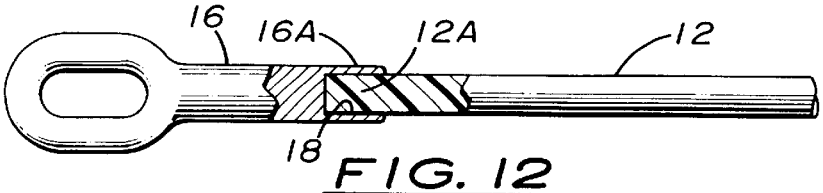
FIG. 12 (PRIOR ART)
FIG. 12 is a fragmentary view of the fiberglass rod of the prior art insulator of FIG. 1 with the end fitting of FIG. 11 attached thereto.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Referring to the drawings and particularly to FIGS. 13 to 16, there is illustrated a first embodiment of the insulator end fitting of the present invention, generally designated 20, for assembling to one end 12A of the fiberglass rod 12 of the insulator 10 of FIG. 1. The end fitting 20 includes a main cast body 22 for securement to an external structure (not shown) and a non-machined annular flange 24 rigidly attached at an end 22A of the main cast body 22 and defining the hole 18 for receiving the one end 12A of the fiberglass rod 12 to secure the annular flange 24 to the fiberglass rod 12 in assembling the insulator 10.

Figures 13, 14, 15, 16, 17, 18, 19, 20, 21, 22, 23, 24:
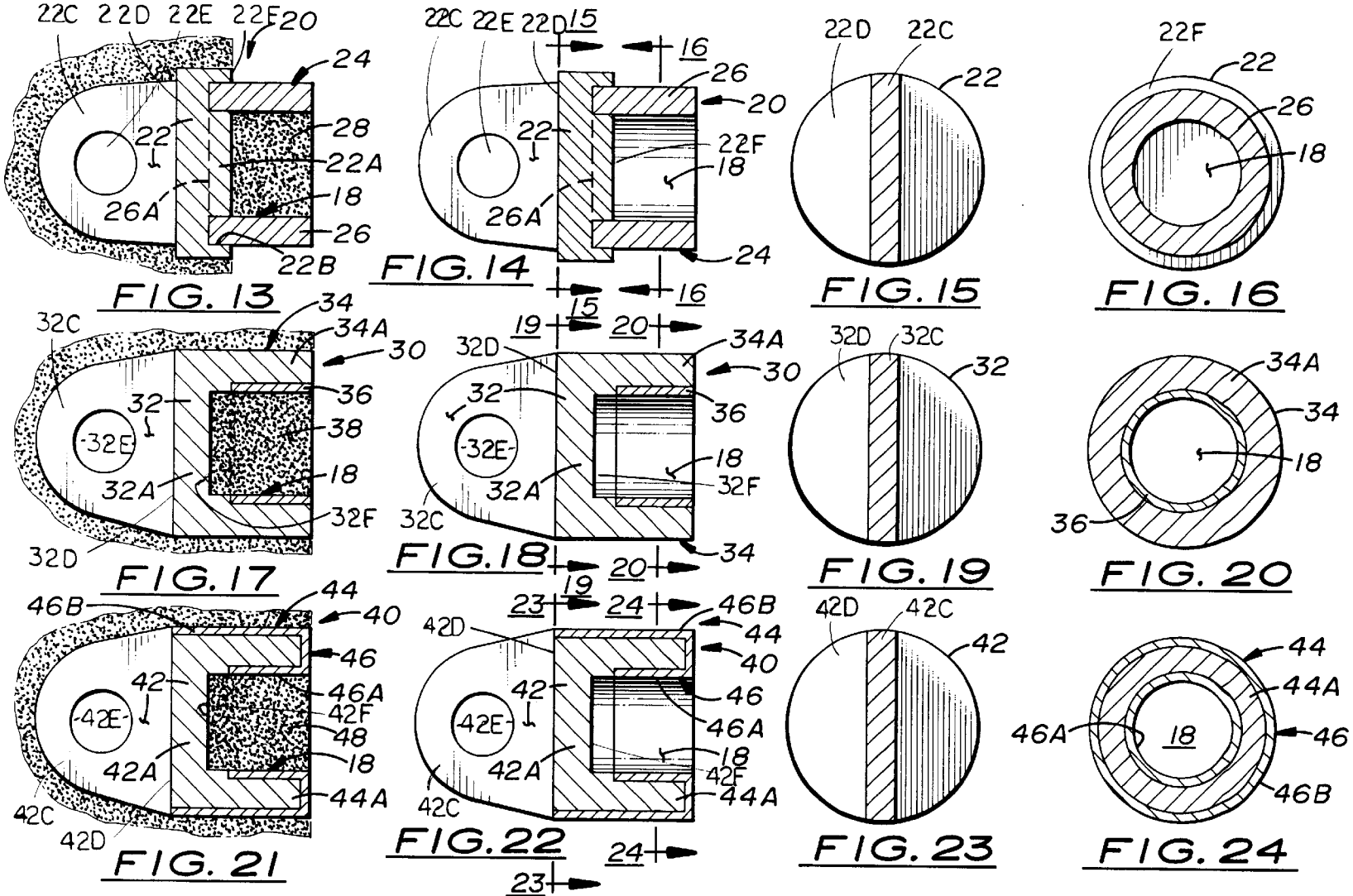
FIG. 13 is a longitudinal sectional view of a first embodiment of the insulator end fitting of the present invention utilizing a preformed section of metal pipe, the end fitting being shown before removal of the casting core material.
FIG. 14 is a sectional view of the end fitting of FIG. 13 after removal of the casting core material.
FIG. 15 is a cross-sectional view of the end fitting taken along line 15—15 of FIG. 14.
FIG. 16 is another cross-sectional view of the end fitting taken along line 16—16 of FIG. 14.
FIG. 17 is a longitudinal sectional view of a second embodiment of the insulator end fitting of the present invention utilizing a precut metal tube, the end fitting being shown before removal of the casting core material.
FIG. 18 is a sectional view of the end fitting of FIG. 17 after removal of the casting core material.
FIG. 19 is a cross-sectional view of the end fitting taken along line 19—19 of FIG. 18.
FIG. 20 is another cross-sectional view of the end fitting taken along line 20—20 of FIG. 18.
FIG. 21 is a longitudinal sectional view of a third embodiment of the insulator end fitting of the present invention utilizing a prestamped tubular member, the end fitting being shown before removal of the casting core material.
FIG. 22 is a sectional view of the end fitting of FIG. 21 after removal of the casting core material.
FIG. 23 is a cross-sectional view of the end fitting taken along line 23—23 of FIG. 22.
FIG. 24 is another cross-sectional view of the end fitting taken along line 23—23 of FIG. 22.

In the first embodiment, the annular flange 24 of the end fitting 20 is comprised entirely of a preformed annular member in the form of a section of pipe 26 which defines the hole 18 and both interior and exterior diameters D1, D2 of the annular flange 26. The end 22A of the main cast body 22 has an annular recess 22B receiving an end 26A of the section of pipe 26 such that the main cast body 22 is rigidly attached to the end 26A of the section of pipe 26. The main cast body 22 is made of ductile iron whereas the section of pipe 26 is made of low carbon steel. FIGS. 13 and 14 show the first embodiment of the end fitting 20 respectively before removal of casting core material 28. The presence of the core material 28 within the section of pipe 26 supports the pipe 26 during the casting of the main body 22.

Referring to FIGS. 17 to 20, there is illustrated a second embodiment of the insulator end fitting of the present invention, generally designated 30, for assembling to the one end 12A of the fiberglass rod 12 of the insulator 10 of FIG. 1. The end fitting 30 includes a main cast body 32 for securement to an external structure (not shown) and a non-machined annular flange 34 rigidly attached at an end 32A of the main cast body 32 and defining the hole 18 for receiving the one end 12A of the fiberglass rod 12 to secure the annular flange 34 to the fiberglass rod 12 in assembling the section insulator 10.

In the second embodiment, the annular flange 34 of the end fitting 30 is comprised partially of a preformed annular member in the form of a precut metal tube 36 disposed at the interior diameter D1 of the annular flange 34 which defines the hole 18 and only the interior diameter D1 of the annular flange 36. The annular flange 34 includes an annular cast body 34A surrounding the precut metal tube 36 and integrally attached to the main cast body 32 at the end 32A thereof and made of the same material as the main cast body 32, such as ductile iron. The precut metal tube 36 is made of carbon steel. FIGS. 17 and 18 show the second embodiment of the end fitting 30 respectively before and after removal of casting core material 38. The presence of the core material 38 within the precut metal tube 36 supports the tube 36 during the casting of the main body 32.

Referring to FIGS. 21 to 24, there is illustrated a third embodiment of the insulator end fitting of the present invention, generally designated 40, for assembling to the one end 12A of the fiberglass rod 12 of the insulator 10 of FIG. 1. The end fitting 40 includes a main cast body 42 for securement to an external structure (not shown) and a non-machined annular flange 44 rigidly attached at an end 42A of the main cast body 42 and defining the hole 18 for receiving the one end 12A of the fiberglass rod 12 to secure the annular flange 44 to the fiberglass rod 12 in assembling the insulator 10.

In the third embodiment, the annular flange 44 of the end fitting 40 is comprised partially of a preformed annular member in the form of a prestamped tubular member 46 having interior and exterior annular walls 46A, 46B disposed at both the interior and exterior diameters D1, D2 of the annular flange 44 which defines the hole 18 and both the interior and exterior diameters D1, D2 of the annular flange 46. The annular flange 44 includes an annular cast body 44A disposed between the interior and exterior annular walls 46A, 46B of the prestamped metal tubular member 46 and integrally attached to the main cast body 42 at the end 42A thereof and made of the same material as the main cast body 42. The main and annular cast bodies 42, 44A are made of ductile iron whereas the prestamped tubular member 46 is made of steel, however, both could be made of aluminum. FIGS. 21 and 22 show the third embodiment of the end fitting 40 respectively before and after removal of casting core material 48. The presence of the core material 48 within the prestamped metal tubular member 46 supports the tubular member 46 during the casting of the main body 42.

In each of the three embodiments described above, the respective end 22A, 32A, 42A of the main cast body 22, 32, 42 takes the form of a transverse solid wall. Each respective main cast body 22, 32, 42 has a connection tab 22C, 32C, 42C which is integral with and extends outwardly from a respective first side 22D, 32D, 42D of the transverse solid wall 22A, 32, 42A and is provided with a respective through-hole 22E, 32E, 42E for securement to an external structure (not shown). Furthermore, in each of the above-described embodiments, the respective annular flange 24,34,44 extends outwardly from a respective second side 22F, 32F, 42F of the solid transverse wall 22A, 32A, 42A in an opposite direction from the respective connection tab 22C, 32C, 42C.

What is claimed is:

1. An end fitting for an insulator, comprising:

(a) a main cast body having a transverse solid wall and a connection tab integral with said transverse solid wall and extending outwardly from a first side of said transverse solid wall for securement to an external structure; and (b) a non-machined annular flange rigidly attached to said transverse solid wall of said main cast body at a second side of said transverse solid wall opposite from said first side thereof, said annular flange defining a hole for receiving an end of a fiberglass rod to secure said annular flange to said fiberglass rod in assembling an insulator, at least a portion of said annular flange being comprised of a preformed annular member defining an interior diameter of said annular flange.

2. The end fitting as recited in claim 1, wherein said preformed annular member defines an exterior diameter and said interior diameter of said annular flange.

3. The end fitting as recited in claim 1, wherein said main cast body is made of a first metal and said preformed annular member is a section of pipe made of a second metal different from said first metal.

4. The end fitting as recited in claim 3, wherein said second side of said transverse solid wall of said main cast body has an annular recess receiving an end of said section of pipe such that said main cast body is rigidly attached to said end of said section of pipe.

5. The end fitting as recited in claim 1, wherein said preformed annular member is a precut metal tube.

6. The end fitting as recited in claim 5, wherein said annular flange includes an annular cast body surrounding said precut metal tube and integrally attached to said main cast body at said second side of said transverse solid wall and made of the same material as said main cast body.

7. The end fitting as recited in claim 5, wherein said main and annular cast bodies are made of a first metal and said precut metal tube is made of a second metal different from said first metal.

8. The end fitting as recited in claim 1, wherein said preformed annular member is a prestamped metal tubular member having interior and exterior annular walls.

9. The end fitting as recited in claim 8, wherein said annular flange includes an annular cast body disposed between said interior and exterior annular walls of said prestamped metal tubular member and integrally attached to said main cast body at said second side of said transverse solid wall and made of the same material as said main cast body.

10. The end fitting as recited in claim 8, wherein said main and annular cast bodies are made of a first metal and said prestamped metal tubular member is made of a second metal different from said first metal.

11. An insulator, comprising:

(a) an elongated fiberglass rod having a pair of opposite ends;

(b) a plurality of weathersheds disposed along said fiberglass rod between said opposite ends thereof; and (c) a pair of end fittings each crimped to one of said opposite ends of said fiberglass rod, each of said end fittings including (i) a main cast body having a transverse solid wall and a connection tab integral with said transverse solid wall and extending outwardly from a first side of said transverse solid wall for securement to an external structure, and (ii) a non-machined annular flange rigidly attached to said transverse solid wall of said main cast body at a second side of said transverse solid wall opposite from said first side thereof, said annular flange forming a hole receiving one of said ends of said fiberglass rod, said annular flange being crimped to said one end of said fiberglass rod, at least a portion of said annular flange being comprised of a preformed annular member defining an interior diameter of said annular flange.

12. The insulator as recited in claim 11, wherein said preformed annular member defines an exterior diameter and said interior diameter of said annular flange.

13. The insulator as recited in claim 11, wherein said main cast body is made of a first metal and said preformed annular member is a section of pipe made of a second metal different from said first metal.

14. The insulator as recited in claim 13, wherein said second side of said transverse solid wall of said main cast body has an annular recess receiving an end of said section of pipe such that said main cast body is rigidly attached to said end of said section of pipe.

15. The insulator as recited in claim 11, wherein said preformed annular member is a precut metal tube.

16. The insulator as recited in claim 15, wherein said annular flange includes an annular cast body surrounding said precut metal tube and integrally attached to said main cast body at said second side of said transverse solid wall thereof and made of the same material as said main cast body.

17. The insulator as recited in claim 15, wherein said main and annular cast bodies are made of a first metal and said precut metal tube is made of a second metal different from said first metal.

18. The insulator as recited in claim 11, wherein said preformed annular member is a prestamped metal tubular member having interior and exterior annular walls.

19. The insulator as recited in claim 18, wherein said annular flange includes an annular cast body disposed between said interior and exterior annular walls of said prestamped metal tubular member and integrally attached to said main cast body at said second side of said transverse solid wall and made of the same material as said main cast body.

20. The insulator as recited in claim 18, wherein said main and annular cast bodies are made of a first metal and said prestamped metal tubular member is made of a second metal different from said first metal.

* * * * *